US008323864B2

(12) United States Patent
Koo et al.

(10) Patent No.: US 8,323,864 B2
(45) **Date of Patent: *Dec. 4, 2012**

(54) TONER TO DEVELOP AN ELECTROSTATIC LATENT IMAGE AND METHOD OF PREPARING THE SAME

(75) Inventors: Tae-hoe Koo, Seoul (KR); Min-young Cheong, Seoul (KR); Jun-young Lee, Seoul (KR); Jae-hwan Kim, Seoul (KR); Yo-da Shin, Incheon Metropolitan (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 165 days.

This patent is subject to a terminal disclaimer.

(21) Appl. No.: 12/648,342

(22) Filed: Dec. 29, 2009

(65) Prior Publication Data

US 2010/0178605 A1 Jul. 15, 2010

(30) Foreign Application Priority Data

Jan. 15, 2009 (KR) ..... 10-2009-0003403

(51) Int. Cl.
*G03G 9/097* (2006.01)

(52) U.S. Cl. ..... 430/108.7; 430/108.1; 430/108.3; 430/108.8; 430/110.1

(58) Field of Classification Search ..... 430/108.1, 430/108.3, 108.7, 108.8, 110.1
See application file for complete search history.

(56) References Cited

U.S. PATENT DOCUMENTS

| | | | | |
|---|---|---|---|---|
| 2007/0009822 | A1* | 1/2007 | Iijima et al. | 430/108.2 |
| 2008/0090166 | A1* | 4/2008 | Jones et al. | 430/137.1 |
| 2008/0166649 | A1* | 7/2008 | Moffat et al. | 430/108.8 |
| 2010/0151376 | A1* | 6/2010 | Kim et al. | 430/108.7 |

FOREIGN PATENT DOCUMENTS

JP 2009-092864 * 4/2009

OTHER PUBLICATIONS

Translation of JP 2009-092864 published Apr. 2009.*
Chinese Office Action Issued on May 30, 2012 in CN Patent Application No. 201010161650.6.

* cited by examiner

*Primary Examiner* — Peter Vajda
(74) *Attorney, Agent, or Firm* — Stanzione & Kim, LLP

(57) ABSTRACT

A toner to develop an electrostatic latent image which includes a latex, a colorant, and a release agent, wherein the toner has a complex viscosity (η*) in a range of about $2.5\times10^2$ to about $1.0\times10^3$ Pa·s and a loss tangent (tan δ) in a range of about 1.3 to about 2.3 at a temperature of about 160° C. and wherein the η* is defined by a formula η*=(G'2+G"2)½/w, and the tan δ is defined by a formula G"/G', where G' is a storage elastic modulus and G" is a loss elastic modulus as determined under the following conditions of an angular velocity being about 6.28 rad/s and at a temperature increasing at a rate of about 2.0° C./min.

8 Claims, 2 Drawing Sheets

TONER TO DEVELOP AN ELECTROSTATIC LATENT IMAGE AND METHOD OF PREPARING THE SAME

CROSS-REFERENCE TO RELATED APPLICATIONS

This application claims priority under 35 U.S.C. §119(a) from Korean Patent Application No. 10-2009-0003403, filed on Jan. 15, 2009, in the Korean Intellectual Property Office, the disclosure of which is incorporated herein by reference in its entirety.

BACKGROUND

1. Field of the Invention

The present general inventive concept relates to a toner to develop an electrostatic latent image and a method of preparing the same.

2. Description of the Related Art

In electrophotographic processes or electrostatic recording processes, a developer used to realize an electrostatic image or an electrostatic latent image can be classified as a two-component developer formed of toner and carrier particles or a one-component developer formed only of toner. The one-component developer can be classified as a magnetic one-component developer or a nonmagnetic one-component developer. Fluidizing agents such as colloidal silica are often added to the nonmagnetic one-component developer to increase a fluidity of the toner. Typically, coloring particles obtained by dispersing a colorant, such as carbon black, or other additives in a binding resin are used as the toner.

Methods of preparing toner include pulverization and polymerization. In the pulverization method, the toner is obtained by melting and mixing synthetic resins with colorants and, if required, other additives. After the melting and mixing, the toner is obtained by pulverizing the mixture and sorting particles until particles of a desired size are obtained. In the polymerization method, a polymerizable monomer composition is manufactured by uniformly dissolving or dispersing various additives, such as a colorant, a polymerization initiator and, if required, a cross-linking agent and an antistatic agent in a polymerizable monomer. Then, the polymerizable monomer composition is dispersed in an aqueous dispersive medium, which includes a dispersion stabilizer by using an agitator to shape minute liquid droplet particles. Subsequently, a temperature of the aqueous dispersive medium is increased and suspension polymerization is performed to obtain polymerized toner having coloring polymer particles of a desired size.

In an image forming apparatus such as an electrophotographic apparatus or an electrostatic recording apparatus, an image is formed by exposing an image on a uniformly charged photoreceptor to form an electrostatic latent image thereon, attaching toner to the electrostatic latent image to form a toner image, transferring the toner image onto a transfer medium such as transfer paper, and then fixing the toner image onto the transfer medium by using any of a variety of methods, including heating, pressurizing, and solvent steaming. In some fixing processes, the transfer medium having the toner image disposed thereon passes through fixing rollers and pressing rollers and the toner image is fused to the transfer medium by heating and/or pressing.

Images formed by an image forming apparatus such as an electrophotocopier should satisfy requirements of high precision and accuracy. Conventionally, toner used in an image forming apparatus is typically obtained by the pulverization method. In the pulverization method, color particles having a large range of sizes are formed. Therefore, to obtain satisfactory developing properties, there is a need to sort the color particles obtained through the pulverization method according to size so as to reduce a particle size distribution. However, it is difficult to precisely control the particle size and the particle size distribution by using a conventional mixing/pulverizing process in the manufacture of toner that is suitable for an electrophotographic process or an electrostatic recording process. Also, when preparing a fine-particle sized toner, the toner preparation yield is adversely affected by the sorting process. In addition, there are limits to a change/adjustment of a toner design to obtain desirable charging and fixing properties. Accordingly, polymerized toner, wherein size of the toner particles are easy to control and which do not need to undergo a complex manufacturing process, such as sorting, have been highlighted recently.

When toner is prepared through the polymerization method, polymerized toner having a desired particle size and particle size distribution may be obtained without pulverizing or sorting. However, although the polymerization method is used, it is necessary to improve physical properties of the toner, including fixability and durability of the toner in order to ensure high printing performance and picture quality. Thus, there is need to develop a toner having optimized rheological properties.

SUMMARY OF THE INVENTION

The present general inventive concept provides a toner of electrophotography used to develop an electrostatic latent image.

The present general inventive concept also provides a method to prepare a toner of electrophotography used to develop an electrostatic latent image.

Additional features and/or utilities of the present general inventive concept will be set forth in part in the description which follows and, in part, will be obvious from the description, or may be learned by practice of the general inventive concept.

The present general inventive concept may be achieved by providing a toner used to develop an electrostatic latent image, the toner including a latex, a colorant, and a release agent, wherein the toner has a complex viscosity ($\eta^*$) in a range of about $2.5\times10^2$ to about $1.0\times10^3$ Pa·s and a loss tangent (tan $\delta$) in a range of about 1.3 to about 2.3 at a temperature of about 160° C., wherein the $\eta^*$ is defined by a formula $\eta^*=(G'^2+G''^2)^{1/2}/w$, and the tan $\delta$ is defined by a formula $G''/G'$, where $G'$ is a storage elastic modulus and $G''$ is a loss elastic modulus as determined under the following conditions of an angular velocity being about 6.28 rad/s and at a temperature increasing at a rate of about 2.0° C./min.

The toner may have an acid value of about 0.5 to about 10 mg KOH/g.

The present general inventive concept may also be achieved by providing a toner supplying unit including a toner tank to store toner, a supplying part disposed on an inner side of the toner tank to discharge the toner from the toner tank, and a toner agitating member rotatably disposed within the toner tank to agitate the toner in almost an entire inner space of the toner tank including a location on a top surface of the supplying part, wherein the toner includes a latex, a colorant, and a release agent, the toner having a complex viscosity ($\eta^*$) in a range of about $2.5\times10^2$ to about $1.0\times10^3$ Pa·s and a loss tangent (tan $\delta$) in a range of about 1.3 to about 2.3 at a temperature of about 160° C., wherein the $\eta^*$ is defined by a formula $\eta^*=(G'^2+G''^2)^{1/2}/w$, and the tan $\delta$ is defined by a formula G"/G', where G' is a storage elastic modulus and G" is a loss elastic modulus as determined under the following conditions of an angular velocity being about 6.28 rad/s and at a temperature increasing at a rate of about 2.0° C./min.

The present general inventive concept may also be achieved by providing an imaging apparatus including an image carrier, an image forming unit to form an electrostatic latent image on a surface of the image carrier, a unit receiving a toner, a toner supplying unit to supply the toner onto a surface of the image carrier to develop the electrostatic latent image thereon, and a toner transferring unit to transfer the toner image to a transfer medium from the surface of the image carrier, wherein the toner includes a latex, a colorant, and a release agent, the toner having a complex viscosity (η*) in a range of about $2.5\times10^2$ to about $1.0\times10^3$ Pa·s and a loss tangent (tan δ) in a range of about 1.3 to about 2.3 at a temperature of about 160° C., wherein the η* is defined by a formula $\eta^*=(G'^2+G''^2)^{1/2}/w$, and the tan δ is defined by a formula G"/G', where G' is a storage elastic modulus and G" is a loss elastic modulus as determined under the following conditions of an angular velocity being about 6.28 rad/s and at a temperature increasing at a rate of about 2.0° C./min. s The present general inventive concept may also be achieved by providing a developer to develop an electrostatic latent image, the developer comprising a toner having a latex, a colorant, and a release agent, wherein the toner has a complex viscosity (η*) in a range of about $2.5\times10^2$ to about $1.0\times10^3$ Pa·s, where the η* is defined by a formula η*=(G'2+G"2)½/w, G' is a storage elastic modulus, and G" is a loss elastic modulus.

The toner may have a loss tangent (tan δ) in a range of about 1.3 to about 2.3 at a temperature of about 160° C.

The tan δ may be defined by a formula G"/G' determined at an angular velocity being about 6.28 rad/s and at a temperature increasing at a rate of about 2.0° C./min.

According to the foregoing and/or other features and utilities of the present general inventive concept, a toner may be achieved, which is capable of obtaining excellent image quality having sufficient gloss and exhibiting a satisfactory fixing property and improved durability.

BRIEF DESCRIPTION OF THE DRAWINGS

These and/or other features and utilities of the present general inventive concept will become apparent and more readily appreciated from the following description of the exemplary embodiments, taken in conjunction with the accompanying drawings of which.

DETAILED DESCRIPTION OF THE EMBODIMENTS

Figure 1:
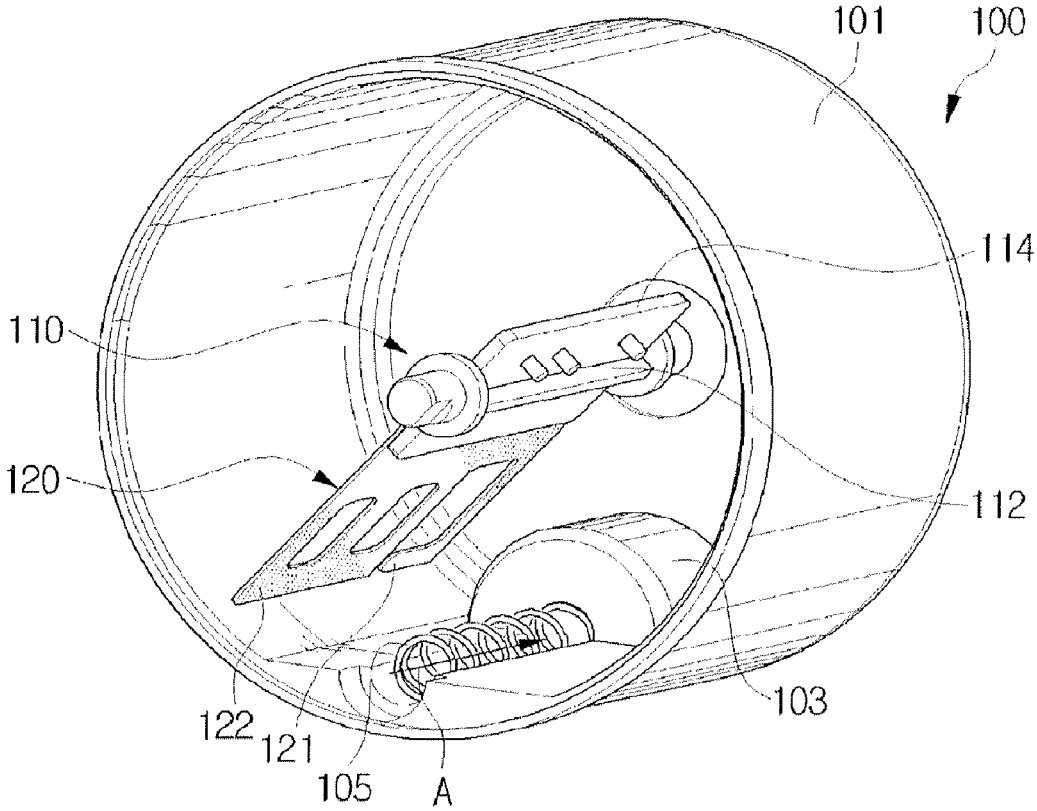
FIG. 1 is perspective view of a toner supplying unit according to an exemplary embodiment of the present inventive concept.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

In exemplary embodiments, a toner used to develop an electrostatic latent image includes a latex, a colorant, and a release agent, wherein the toner has a complex viscosity (η*) in a range of about $2.5\times10^2$ to about $1.0\times10^3$ Pa·s and a loss tangent (tan δ) in a range of about 1.3 to about 2.3 at a temperature of about 160° C. However, the present general inventive concept is not limited thereto.

In exemplary embodiments, the toner is subjected to variations within a developing device or a fusing device with respect to changes in temperature and pressure. Accordingly, in order to achieve desired durability and fixability characteristics of the toner, a viscosity of the toner, which is a physical property of the toner is measured. In this case, the viscosity is measured by completely homogenizing a viscous composition to be subjected to a general viscosity measurement technique. However, in a case of a material having viscoelasticity, such as a toner, specifically, a toner incorporating wax and/or pigments distributed therein, it is important to measure viscous properties of the toner while maintaining a distribution feature thereof.

Accordingly, the toner is evaluated by a complex viscosity η* defined by the following formula:

$$\eta^*=(G'^2+G''^2)^{1/2}/w,$$

where G' is a storage elastic modulus and G" is a loss elastic modulus under the following conditions of an angular velocity being about 6.28 rad/s and at a temperature increasing at a rate of about 2.0° C./min. The η* may be determined by using a temperature dispersion measurement by sinusoidal vibration through an advanced rheometric expansion system (ARES) apparatus manufactured by Rheometric Scientific Co. However, the present general inventive concept is not limited thereto.

A tan δ may be defined by a ratio, G"/G', of a loss elastic modulus G" to a storage elastic modulus G' of toner. Here, the storage elastic modulus G' is related to an elasticity of the toner, and the loss elastic modulus G" is related to a plasticity of the toner. Thus, when the storage elastic modulus increases, the elasticity of the toner increases. When the loss elastic modulus increases, the plasticity of the toner increases. In exemplary embodiments, it is important to adjust a molar ratio of elasticity to plasticity, while maintaining a desired elasticity in order to maintain a sufficient gloss of a fixed image.

In exemplary embodiments, the η* of the toner at a temperature of about 160° C. may be in ranges of about $2.5\times10^2$ Pa·s to about $1.0\times10^3$ Pa·s, about $3.0\times10^2$ Pa·s to about $9.0\times10^2$ Pa·s, and about $4.0\times10^2$ Pa·s to about $8.0\times10^2$ Pa·s. However, the present general inventive concept is not limited thereto.

When the η* is less than $2.5\times10^2$ Pa·s, a cohesive force of the toner may be reduced to cause a hot-offset phenomenon at a relatively low temperature. On the other hand, when the η* is larger than $1.0\times10^3$ Pa·s, the cohesive force of the toner may be excessively increased, so that an adhesion between a transfer medium and the toner decreases to be less than an adhesion between the toner and a roller, thereby resulting in an occurrence of a cold-offset phenomenon or an unstable fixed image. In addition, it is not easy to obtain a surface glossiness of a final fixed image and a sufficient toner fixability.

In exemplary embodiments, the tan δ of the toner at a temperature of about 160° C. may be in ranges of about 1.3 to about 2.3, about 1.31 to about 2.25, and about 1.32 to about 2.23. However, the present general inventive concept is not limited thereto.

When the tan δ of the toner is less than 1.3, the toner exhibits poor fixability and a decreased ability to separate from the transfer medium, so that a probability of a cold-offset phenomenon of the toner occurring increases.

When the tan δ of the toner is larger than 2.3, toner-to-blade adhesion or toner-to-toner adhesion may be caused due to an increase in an evaporation temperature of a developing unit or a constant stress applied to the toner, thereby resulting in poor durability at high temperatures and vulnerability to an occurrence of streaks in a final fixed image.

The η* and tan δ of the toner may be comprehensively evaluated by properties of raw materials, such as a latex, a colorant, a release agent and a agglomerating agent, and physical properties of the manufactured toner, including a thermal property, e.g., a glass transition temperature (Tg), a degree of cross-linking, dispersion capability in toner, a molecular weight of the toner, particle size distribution, and so on.

In exemplary embodiments, the toner includes sulfur (S), iron (Fe) and silicon (Si), and when the contents thereof, as measured by fluorescent X-ray analysis, are indicated by [S], [Fe] and [Si], the toner may have a content ratio of [S] to [Fe] in a range of about $5.0\times10^{-4}$ to about $5.0\times10^{-2}$. In addition, the toner may have a content ratio of [Si] to [Fe] in a range of about $5.0\times10^{-4}$ to about $5.0\times10^{-2}$. However, the present general inventive concept is not limited thereto.

In exemplary embodiments, in order to adjust a molecular weight distribution of latex in preparing the latex for use in the toner, a chain transfer agent, e.g., a sulfur-containing compound, may be used. Here, the [S] is a numerical value corresponding to an amount of sulfur contained in the chain transfer agent. Accordingly, when the [S] is high, the molecular weight of latex may be reduced and new chains may be initiated by using the chain transfer agent. On the other hand, when the [S] is low, chains continuously grow, so that the molecular weight of the latex may be increased.

The [Fe] is a numerical value corresponding to an amount of iron contained in the agglomerating agent used to agglomerate the latex, the colorant, and the release agent in the process of preparing the toner. Thus, the agglomerating property, particle size distribution and particle sizes of an agglomerated toner, that is, a precursor for preparing the target toner, may be affected by the [Fe]. However, the present general inventive concept is not limited thereto.

The [Si] corresponds to a sum of the amount of Si contained in polysilicate contained in an agglomerating agent and the amount of Si contained in silica that is added to secure a flowability of the toner. The agglomerating property, particle size distribution and particle sizes, and rheological properties of the toner may be affected by the [Si].

In exemplary embodiments, the [S] to [Fe] ratio may be in ranges of about $5.0\times10^{-4}$ to about $5.0\times10^{-2}$, about $8.0\times10^{-4}$ to about $3.0\times10^{-2}$, and about $1.0\times10^{-3}$ to However, the present general inventive concept is not limited thereto.

When the [S] to [Fe] ratio is less than $5.0\times10^{-4}$, the [S] may be too low. Thus, the molecular weight of toner may be reduced. In addition, an excess [Fe] may adversely affect the agglomerating property or cause problems such as a charge reduction. On the other hand, when the [S] to [Fe] ratio exceeds the range of $5.0\times10^{-2}$, the [S] is too high, the molecular weight of toner is substantially reduced. Otherwise, a shortage of [S] may adversely affect the agglomerating property, and the particle size distribution or particle size of toner may be substantially affected.

In exemplary embodiments, the [Si] to [Fe] ratio may be in ranges of about $5.0\times10^{-4}$ to about $5.0\times10^{-2}$, about $8.0\times10^{-4}$ to about $3.0\times10^{-2}$, and about $1.0\times10^{-3}$ to about $1.0\times10^{-2}$. However, the present general inventive concept is not limited thereto.

When the [Si] to [Fe] ratio is less than $5.0\times10^{-4}$, an amount of silica as an external additive is too small to obtain sufficient rheological properties of the toner. On the other hand, when the [Si] to [Fe] ratio exceeds the range of $5.0\times10^{-2}$, the silica content as the external additive is too high, and therefore may cause an interior of a printer to become contaminated.

The present general inventive concept provides a method to prepare a toner of electrophotography and a method of developing an electrostatic latent image, which includes preparing a mixture solution by mixing first latex particles with a colorant dispersion and a release agent dispersion, preparing a first agglomerated toner by adding an agglomerating agent to the mixture solution and preparing a second agglomerated toner by coating the first agglomerated toner with a second latex prepared by polymerizing at least one polymerizable monomer, wherein the toner has a complex viscosity (η*) in a range of about $2.5\times10^{2}$ to about $1.0\times10^{3}$ Pa·s and a loss tangent (tan δ) in a range of about 1.3 to about 2.3 at a temperature of about 160° C., and the η* is defined by the following formula $\eta^*=(G'^2+G''^2)^{1/2}/w$, and the tan δ is defined by the formula G"/G', where G' is a storage elastic modulus and G" is a loss elastic modulus under the following conditions of an angular velocity being about 6.28 rad/s and at a temperature increasing at a rate of about 2.0° C./min.

Exemplary embodiments of the agglomerating agent include, but are not limited to, NaCl, MgCl2, MgCl2.8H20, [Al2(OH)nCl6-n]m (Al2(SO4)3.18H2O, PAC (polyaluminum chloride), polyaluminum sulfate (PAS), polyaluminum hydroxidechloride sulfate silicate (PASS), ferric sulfate, ferrous sulfate, ferrous chloride, calcium hydroxide, potassium carbonate, and a metal salt including Si and Fe.

An amount of the agglomerating agent may be about 0.1 to about 10 parts by weight, for example, about 0.5 to about 8 parts by weight, and specifically, about 1 to about 6 parts by weight, based on 100 parts by weight of the first latex particles. When the amount of the agglomerating agent is less than about 0.1 parts by weight based on 100 parts by weight of the first latex particles, the agglomeration efficiency may be deteriorated. On the other hand, when the amount of the agglomerating agent is larger than about 10 parts by weight based on 100 parts by weight of the first latex particles, problems such as a charge reduction or deterioration in a particle size distribution may occur.

In an exemplary embodiment of the present general inventive concept, the toner uses a metal salt containing Si and Fe as an agglomerating agent in the method to prepare the toner of electrophotography, the amounts of Si and Fe may each be in ranges of about 3 to about 30,000 ppm, about 30 to about 25,000 ppm, and about 300 to about 20,000 ppm. When the amounts of Si and Fe are each less than 3 ppm, the additional effect of Si and Fe may not be noticeable. On the other hand, when the amounts of Si and Fe are each larger than 30,000 ppm, problems such as charge reduction or contamination of an interior of a printer may occur.

The metal salt containing Si and Fe may include polysilicate iron. In particular, the size of the first agglomerated toner may be increased by an ionic strength increased by adding the metal salt containing Si and Fe and collisions between the latex particles. However, the present general inventive concept is not limited thereto.

In an exemplary embodiment, the metal salt containing Si and Fe may be polysilicate iron. Specifically, examples of commercially available metal salt containing Si and Fe include PSI-025, PSI-050, PSI-085, PSI-100, PSI-200, and PSI-300, which are manufactured by Suido Kiko Co. Physical properties and compositions of PSI-025, PSI-050, PSI-085, PSI-100, PSI-200, and PSI-300 are listed below. However, the present general inventive concept is not limited thereto.

TABLE 1

| Type | | PSI-025 | PSI-050 | PSI-085 | PSI-100 | PSI-200 | PSI-300 |
|---|---|---|---|---|---|---|---|
| Si/Fe molar ratio (Si/Fe) | | 0.25 | 0.5 | 0.85 | 1 | 2 | 3 |
| Main component concentration | Fe (wt %) | 5.0 | 3.5 | 2.5 | 2.0 | 1.0 | 0.7 |
| | $SiO_2$ (wt %) | 1.4 | 1.9 | 2.0 | | 2.2 | |
| pH (1 w/v %) | | 2-3 | | | | | |
| Specific gravity (20° C.) | | 1.14 | 1.13 | 1.09 | 1.08 | 1.06 | 1.04 |
| Viscosity (mPa · s) | | 2.0 or more | | | | | |
| Average molecular weight (Dalton) | | 500,000 | | | | | |
| Appearance | | Yellowish transparent liquid | | | | | |

When the metal salt containing Si and Fe is used as an agglomerating agent in the method to prepare the toner, the agglomerating effect is increased, so that the toner may be formed into small particles and the particle size distribution may be controlled. In addition, since the metal salt is primarily based on Fe and Si, it is safe for the environment and to humans.

In exemplary embodiments, a molecular weight of the metal salt containing Si and Fe may be in ranges of about 100,000 Dalton to about 900,000 Dalton, about 200,000 Dalton to about 750,000 Dalton, and about 500,000 Dalton. However, the present general inventive concept is not limited thereto.

When the molecular weight of the metal salt containing Si and Fe is less than 100,000 Dalton, a minimum fusing temperature (MFT) of the prepared toner is raised, so that a fixing area is reduced and a glossiness of the toner is degraded. On the other hand, when the molecular weight of the metal salt containing Si and Fe is larger than 900,000 Dalton, storage stability at high temperatures may be degraded and streaks in a fixed image may occur.

In exemplary embodiments, an average particle size of the toner according to the present general inventive concept may be in ranges of about 3 to about 8 μm, about 4 to about 7.5 μm, and about 4.5 to about 7 μm, and an average circularity of the toner may be in ranges of about 0.940 to about 0.990, about 0.945 to about 0.985, and about 0.950 to about 0.980. However, the present general inventive concept is not limited thereto.

In general, when the toner advantageously has relatively small particle sizes, it may achieve high resolution and high image quality, which are, however, disadvantageous features in view of transfer speed and cleaning capacity. Accordingly, it is important to obtain a toner having appropriate particle sizes to achieve desired resolution and image quality, while providing a desired transfer speed and cleaning capacity.

A volume average particle diameter of the toner may be measured by an electrical impedance analysis.

When the volume average particle diameter of the toner is less than 3 μm, problems, such as contamination of a photoreceptor, a reduced yield of the toner or toner scattering, which present a risk to humans, may occur. When the volume average particle diameter of the toner is larger than 8 μm, it is difficult to obtain images having high resolution and high quality, charging may not be uniformly performed, fixing properties of the toner may be decreased, and a Doctor-Blade may not be able to regulate the toner layer.

When an average circularity of toner is less than 0.940, an image developed on a transfer medium is relatively high, which means that a toner consumption is increased, porosity between toner particles is overly increased, thereby resulting in poor coating efficiency on a developed image. Accordingly, in order to obtain a required image concentration, a much larger amount of toner is required, which increases the toner consumption. On the other hand, when the average circularity of toner is larger than about 0.990, the toner may be excessively fed to a sleeve for development, and the sleeve may not be uniformly coated with the toner, which thereby contaminates the sleeve.

The circularity of toner as defined by the following expression may be determined with a flow-type particle image analyzer (FPIA) (FPIA-3000 Model, manufactured by Sysmex Corporation).

$$\text{Circularity}=2\times(\pi\times\text{area})^{0.5}/\text{perimeter}$$

The circularity may be in a range of 0 to 1, with a value of 1 corresponding to a perfect circle.

Meanwhile, a toner particle distribution coefficient may be a volume average particle diameter distribution coefficient GSDv or a number average particle diameter distribution coefficient GSDp, and the GSDv and the GSDp may be measured in the following manner.

First, a toner particle diameter distribution is obtained by using toner particle diameters measured by using a Multisizer III (manufactured by Beckman Coulter Inc.). The toner particle diameter distribution is divided at predetermined particle diameter ranges (channels). With respect to the respective divided particle diameter ranges (channels), a cumulative volume distribution of toner particles and the cumulative number distribution of toner particles are measured, wherein, in each of the cumulative volume and number distributions, the particle size in each distribution is increased in a direction from a left hand side to a right hand side. A particle diameter at 16% of the respective cumulative distributions is defined as a volume average particle diameter D16v and a number average particle diameter D16p, respectively. Similarly, a particle diameter at 50% of the respective cumulative distributions is defined as a volume average particle diameter D50v and a number average particle diameter D50p, respectively. Also similarly, a particle diameter at 84% of the respective cumulative distributions is defined as a volume average particle diameter D84v and a number average particle diameter D84p.

In the present exemplary embodiment, GSDv is defined as $(D84v/D16v)^{0.5}$, and GSDp is defined as $(D84p/D16p)^{0.5}$.

The GSDv and GSDp values of the toner may be about 1.30 or less, respectively, for example, about 1.15 to about 1.30, and specifically, from 1.20 to about 1.25. When the GSDv and GSDp values are larger than about 1.30, toner particle diameters may not be uniform.

In the method to prepare the toner according to the present general inventive concept, the first latex particles may be polyester used alone, a polymer obtained by polymerizing one or more polymerizable monomers, or a mixture thereof (a hybrid type). When the polymer is used as the first latex particles, the polymerizable monomers may be polymerized with a release agent such as a wax, or a wax may be separately added to the polymer.

The polymerizing may be performed by an emulsion polymerization, in which latex particles having a particle size of 1 μm or less, for example, about 100 to about 300 nm, or about 150 to about 250 nm, may be prepared.

In exemplary embodiments, the polymerizable monomer may be at least one selected from the group consisting of styrene-based monomers, such as styrene, vinyl toluene, and a-methyl styrene; acrylic acid or methacrylic acid; derivatives of (metha)acrylates, such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, and metacryl amide; ethylenically unsaturated mono-olefins, such as ethylene, propylene, and butylenes; halogenized vinyls, such as vinyl chloride, vinylidene chloride, and vinyl fluoride; vinyl esters, such as vinyl acetate, and vinyl propionate; vinyl ethers, such as vinyl methyl ether, and vinyl ethyl ether; vinyl ketones, such as vinyl methyl ketone, and methyl isopropheny l ketone; and nitrogen-containing vinyl compounds, such as 2-vinylpyridine, 4-vinylpyridine and N-vinyl pyrrolidone. However, the present general inventive concept is not limited thereto.

In the preparation of the first latex particles, an initiator and/or a chain transfer agent may be used to achieve efficient polymerization. However, the present general inventive concept is not limited thereto.

Exemplary embodiments of the initiator for radical polymerization include persulfate salts, such as potassium persulfate, and ammonium persulfate; azo compounds, such as 4,4-azobis(4-cyano valeric acid), dimethyl-2,2'-azobis(2-methyl propionate), 2,2-azobis(2-amidinopropane)dihydrochloride, 2,2-azobis-2-methyl-N-1,1-bis(hydroxymethyl)-2-hydroxyethylpropioamide, 2,2'-azobis(2,4-dimethyl valeronitrile), 2,2'-azobis isobutyronitrile, and 1,1-azobis(1-cyclohexanecarbonitrile); and peroxides, such as methyl ethyl peroxide, di-t-butylperoxide, acetyl peroxide, dicumyl peroxide, lauroyl peroxide, benzoyl peroxide, t-butylperoxy-2-ethyl hexanoate, di-isopropyl peroxydicarbonate, and di-t-butylperoxy isophthalate. In addition, an oxidization-reduction initiator in which a polymerization initiator and a reduction agent are combined may also be used.

In exemplary embodiments, a chain transfer agent is a material that converts the type of chain carrier in a chain reaction. A new chain has much less activity than that of a previous chain. The polymerization degree of a polymer may be reduced and new chains may be initiated using the chain transfer agent. In addition, a molecular weight distribution of a polymer may be adjusted using the chain transfer agent.

In exemplary embodiments, an amount of the chain transfer agent may be in ranges of about 0.1 to about 5 parts by weight, about 0.2 to about 3 parts by weight, and about 0.5 to about 2.0 parts by weight, based on 100 parts by weight of at least one polymerizable monomer. When an amount of the chain transfer agent is less than 0.1 parts by weight based on 100 parts by weight of the polymerizable monomer, the molecular weight of a polymer is too large, which may decrease an agglomeration efficiency. On the other hand, when the amount of the chain transfer agent is larger than 5 parts by weight based on 100 parts by weight of the polymerizable monomer, the molecular weight of a polymer is too small, which may deteriorate fixing properties of the toner.

Exemplary embodiments of the chain transfer agent include sulfur-containing compounds, such as dodecanthiol, thioglycolic acid, thioacetic acid, and mercaptoethanol; phosphorous acid compounds, such as phosphorous acid and sodium phosphite; hypophosphorous acid compounds, such as hypophosporous acid and sodium hypophosphite; and alcohols, such as methyl alcohol, ethyl alcohol, isopropyl alcohol, and n-butyl alcohol. However, the present general inventive concept is not limited thereto.

The first latex particles may further include a charge control agent. The charge control agent used herein may be a negative charge type charge control agent or a positive charge type charge control agent. The negative charge type charge control agent may be an organic metal complex or a chelate compound such as an azo dye containing chromium or a mono azo metal complex; a salicylic acid compound containing metal such as chromium, iron and zinc; or an organic metal complex of an aromatic hydroxycarboxylic acid and an aromatic dicarboxylic acid. Moreover, any other known charge control agents may also be used without limitation. The positive charge type charge control agent may be a modified product such as nigrosine and a fatty acid metal salt thereof and an onium salt including a quaternary ammonium salt such as tributylammonium 1-hydroxy-4-naphthosulfonate and tetrabutylammonium tetrafluoro borate which may be used alone or in combination of at least two. Since the charge control agent stably supports the toner on a developing roller by an electrostatic force, charging may be performed stably and quickly by using the charge control agent.

The prepared first latex particles may be mixed with a colorant dispersion. The colorant dispersion may be prepared by homogeneously dispersing a composition including colorants, such as black, cyan, magenta and yellow, and an emulsifier by using an ultrasonic processor, Micro fluidizer, or the like.

Carbon black or aniline black may be used as the colorant for a black toner, and for color toner, at least one of yellow, magenta and cyan colorants may be further included.

A condensation nitrogen compound, an isoindolinone compound, an anthraquine compound, an azo metal complex or an allyl imide compound may be used as the yellow colorant. In particular, C.I. pigment yellow 12, 13, 14, 17, 62, 74, 83, 93, 94, 95, 109, 110, 111, 128, 129, 147, 168, 180, or the like may be used.

A condensation nitrogen compound, an anthraquine compound, a quinacridone compound, a base dye lake compound, a naphthol compound, a benzo imidazole compound, a thioindigo compound or a perylene compound may be used as the magenta colorant. In particular, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like may be used.

A copper phthalocyanine compound and derivatives thereof, an anthraquine compound, or a base dye lake compound may be used as the cyan colorant. In particular, C.I. pigment blue 1, 7, 15, 15:1, 15:2, 15:3, 15:4, 60, 62, 66, or the like may be used.

Such colorants may be used alone or in a combination of at least two colorants, and are selected in consideration of color, chromacity, luminance, resistance to weather, dispersion capability in toner, etc.

The amount of the colorant as described above may be 0.5 to 15 parts by weight, 1 to 12 parts by weight, and may be 2 to 10 parts by weight based on 100 parts by weight of the toner. The amount of the colorant should be sufficient to color the toner; however, when an amount of the colorant is less than 0.5 parts by weight based on 100 parts by weight of the toner, the coloring effect is not sufficient. Alternatively, when the amount of the colorant is larger than about 15 parts by weight based on 100 parts by weight of the toner, the manufacturing costs associated with the toner increases, and thus a sufficient electrification quantity may not be obtained.

In exemplary embodiments, any other emulsifier that is known in the art may also be used as the emulsifier used in the colorant dispersion. In this regard, an anionic reactive emulsifier, a nonionic reactive emulsifier or a mixture thereof may be used. The anionic reactive emulsifier may be HS-10 (Dai-ichi Kogyo, Co., Ltd.), Dawfax 2-A1 (Rhodia Inc.), etc., and the nonionic reactive emulsifier may be RN-10 (Dai-ichi Kogyo, Co., Ltd.).

In exemplary embodiments, the release agent dispersion used in the method to prepare the toner includes a release agent, water, and an emulsifier.

The release agent allows a toner to be fixed on a final image receptor at low temperature and to have excellent durability and excellent abrasion resistance. Thus, it is understood that a type and an amount of the release agent used in the method are important factors to provide desired development characteristics of the toner.

Exemplary embodiments of useful release agents include, but are not limited to, polyethylene-based wax, polypropylene-based wax, silicone wax, paraffin-based wax, ester-based wax, Carnauba wax and metallocene wax. The melting point of the release agent may be about 50° C. to about 150° C. Components of the release agent physically adhere to toner particles, but do not covalently bond to toner particles. The release agent enables a toner to be fixed on a final image receptor at a low fixing temperature and to have good final image durability and abrasion resistance.

In exemplary embodiments, the release agent may be included in an amount of about 1 to about 20 parts by weight, about 2 to about 16 parts by weight, specifically about 3 to 1 about 2 parts by weight, based on the weight of the toner. When an amount of the release agent is less than 1 part by weight, fixing properties may be degraded and a fixing temperature range may be narrowed. On the other hand, when an amount of the release agent is more than 3 parts by weight, a toner storage stability may be degraded.

The releasing agent may be an ester group-containing wax. Exemplary embodiments of the ester group-containing wax include (1) mixtures including ester-based wax and non-ester based wax; and (2) an ester group-containing wax prepared by adding an ester group to a non-ester based wax.

Since an ester group has high affinity with respect to the latex component of toner, wax can be uniformly present among toner particles and the function of the wax is effectively exerted. Meanwhile, if only ester-based wax is used, excessive plasticizing reactions may occur. Thus, the inclusion of the non-ester based wax may result in prevention of such excessive plasticizing reactions due to a releasing reaction with respect to the latex. Therefore, development characteristics of the toner may be maintained at appropriate levels for a long period of time.

Exemplary embodiments of the ester-based wax include esters of C15-C30 fatty acids and 1 to 5 valence alcohols, such as behenic acid behenyl, staric acid stearyl, stearic acid ester of pentaeritritol, or montanic acid glyceride. Also, if an alcohol component that forms ester is a monovalent alcohol, a number of carbon atoms may be in the range of 10 to 30, and if the alcohol component that forms ester is a polymeric alcohol, the number of carbon atoms may be in the range of 3 to 10. However, the present general inventive concept is not limited thereto.

Specifically, examples of the non-ester wax include a polyethylene-based wax, a paraffin wax, and so on.

Exemplary embodiments of the wax containing the ester group include a mixture of a paraffin-based wax and an ester-based wax, paraffin-based waxes containing ester groups, and so on. Specifically, examples of commercially available wax containing the ester group include P-280, P-318, P-319, and so on, which are manufactured by Chukyo yushi Co., Ltd.

When the wax used as the release agent is a mixture of a paraffin-based wax and an ester-based wax, an amount of the ester-based wax may be in a range of about 5 to about 39% by weight, about 7% to about 36% by weight, or about 9% to about 33% by weight, based on the total weight of the release agent.

In exemplary embodiments, an amount of the ester group in the release agent may be in ranges of about 5% to about 39% by weight, about 7% to about 36% by weight, and 9% to about 33% by weight, based on a total weight of the release agent. When the amount of the ester group is less than about 5%, the release agent exhibits poor compatibility to latex. When the amount of the ester group is larger than 39%, the plasticity of toner excessively increases, so that it is difficult to maintain the developing stability of toner for an extended period of time.

In exemplary embodiments, any other emulsifier that is known in the art may be used as the emulsifier used in the pigment dispersion. In alternative exemplary embodiments, an anionic reactive emulsifier, a nonionic reactive emulsifier or a mixture thereof may be used. The anionic reactive emulsifier may be HS-10 (Dai-ichi Kogyo, Co., Ltd.), Dawfax 2-A1 (Rhodia Inc.), etc., and the nonionic reactive emulsifier may be RN-10 (Dai-ichi Kogyo, Co., Ltd.).

The molecular weight, Tg and rheological properties of the first latex particles may be adjusted to efficiently fix toner particles at a low temperature.

The prepared first latex particles, the colorant dispersion and the release agent dispersion are mixed, and then an agglomerating agent is added to the mixture, to thereby prepare an agglomerated toner. More particularly, after the first latex particles, the colorant dispersion and the release agent dispersion are mixed, the agglomerating agent is added to the mixture at pH 1 to 4 to form a first agglomerated toner having an average particle size of 2.5 μm as a core. Then, a second latex is added to the resultant, and the pH is adjusted to 6 to 8. When a particle size is constantly maintained for a certain period of time, the resultant is heated to a temperature in a range of about 90 to about 98° C., and the pH is adjusted to 5.8 to 6 to prepare a second agglomerated toner.

At least one metal salt selected among metal salts containing Si and Fe was used as the agglomerating agent. The metal salts containing Si and Fe may include polysilicate iron.

The second latex may be obtained by polymerizing one or more polymerizable monomers on the first agglomerated toner. The polymerizable monomers are emulsion polymerized to prepare latex having a particle size of less than 1 μm. In an exemplary embodiment, the particle size may be in a range of about 100 to about 300 nm. In exemplary embodiments, the second latex may also include a wax, and the wax may be added to the second latex in the polymerization process.

Meanwhile, a third latex prepared by polymerizing one or more polymerizable monomers may be coated on the second agglomerated toner.

By forming a shell layer with the second latex or the third latex, a durability of the toner may be improved, and storage problems of toner during shipping and handling may be overcome. Here, a polymerization inhibitor may be added in order to prevent or substantially reduce new latex particles from being formed, or the reaction may be performed by using a starved-feeding method to facilitate coating of the monomer mixture on the toner.

The prepared second agglomerated toner or third agglomerated toner is filtered to separate toner particles and the filtered toner particles are dried. The dried toner particles are subject to a surface treatment process by using silica or the like, and a charge amount is controlled to prepare a final dry toner.

In exemplary embodiments, the externally added additive may be silica or $TiO_2$. An amount of the externally added additive may be in a range of about 1.5 to about 7 parts by weight, about 2 to about 5 parts by weight, based on 100 parts by weight of an externally added additive-free toner. When the amount of the externally added additive is less than 1.5 parts by weight, toner particles gather due to a cohesive force, which is a caking phenomenon in which toner particles are attached to each other, and the charge amount is unstable. On the other hand, when the amount of the externally added additive is larger than 7 parts by weight, an excess amount of the externally added additive may contaminate a roller.

According to an exemplary embodiment of the present general inventive concept, an imaging forming method includes forming a visible image by attaching a toner to a surface of a photoreceptor on which an electrostatic latent image is formed, and transferring the visible image to a transfer medium, wherein the toner includes a latex, a colorant, and a release agent, the toner having a complex viscosity ($\eta^*$) in a range of about $2.5\times10^2$ to about $1.0\times10^3$ Pa·s and a loss tangent (tan $\delta$) in a range of about 1.3 to about 2.3 at a temperature of about 160° C., wherein the $\eta^*$ is defined by a formula $\eta^*=(G'^2+G''2)^{1/2}/w$, and the tan $\delta$ is defined by a formula G"/G', where G' is a storage elastic modulus and G" is a loss elastic modulus as determined under the following conditions of an angular velocity being about 6.28 rad/s and at a temperature increasing at a rate of about 2.0° C./min.

Typically, an electrophotographic imaging process includes charging, exposing, developing, transferring, fixing, cleaning, and charge removing operations to form an image on a receiving structure.

In the charging operation, a photoreceptor may be coated with a negative charge or a positive charge by a corona or a charging roller. In an exposing operation, the charged surface of the photoreceptor is selectively discharged to form a latent image in an image-wise manner in which the arrangement of an optical system, typically, a laser scanner or diode, corresponds to a target image that is to be formed on a final image receptor. The electromagnetic irradiation referred to as "light" may be infrared irradiation, visible light irradiation, or ultraviolet irradiation.

In the developing operation, toner particles having sufficient polarity contact the latent image on the photoreceptor, and an electrically biased developer having a same potential polarity as the toner is used. Toner particles move toward the photoreceptor and are selectively attached to the latent image by an electrostatic force so that a toner image is formed on the photoreceptor.

In the transferring operation, the toner image may be transferred from the photoreceptor to the final image receptor. In some cases, an intermediate transferring element is used during the latter part of the transferring operation of the toner image from the photoreceptor to the final image receptor.

In the fixing operation, the toner image on the final image receptor may be heated so that toner particles are softened or melted, to thereby fix the toner image on the final image receptor. In alternative exemplary embodiments, the toner image is fixed on the final image receptor under high pressure and heating, or under high pressure alone.

In the cleaning operation, a residual toner on the photoreceptor may be removed.

In the charge removing operation, charges of the photoreceptor may be exposed to light having a specific wavelength band so that the charges are uniformly reduced to a low value. Therefore, a residual of the latent image is removed and the photoreceptor is prepared for a subsequent imaging cycle.

A toner supplying unit according to an exemplary embodiment of the present general inventive concept includes a toner tank to store toner, a supplying part to project inside the toner tank to discharge the toner, and a toner agitating member rotatably disposed inside the toner tank to agitate the toner in an inner space of the toner tank including a location on a top surface of the supplying part, wherein the toner is used to develop an electrostatic latent image and includes a latex, a colorant, and a release agent, the toner having a complex viscosity ($\eta^*$) in a range of about $2.5\times10^2$ to about $1.0\times10^3$ Pa·s and a loss tangent (tan $\delta$) in a range of about 1.3 to about 2.3 at a temperature of about 160° C., wherein the $\eta^*$ is defined by a formula $\eta^*=(G'^2+G''^2)^{1/2}/w$, and the tan $\delta$ is defined by a formula G"/G', where G' is a storage elastic modulus and G" is a loss elastic modulus as determined under the following conditions of an angular velocity being about 6.28 rad/s and at a temperature increasing at a rate of about 2.0° C./min.

FIG. 1 is a perspective view of a toner supplying apparatus 100 according to an exemplary embodiment of the present general inventive concept.

The toner supplying apparatus 100 includes a toner tank 101, a supplying part 103, a toner-conveying member 105, and a toner-agitating member 110.

The toner tank 101 stores a predetermined amount of toner and may be formed in a substantially hollow cylindrical shape. However, the present general inventive concept is not limited thereto.

The supplying part 103 is disposed at a bottom of the inside of the toner tank 101 and discharges the stored toner from an inside of the toner tank 101 to an outside of the toner tank 101. In an exemplary embodiment, the supplying part 103 may project from the bottom of the toner tank 101 to the inside of the toner tank 101 in a pillar shape with a semi-circular section. The supplying part 103 includes a toner outlet (not illustrated) to discharge the toner to an outer surface of the toner tank 101.

The toner-conveying member 105 may be disposed at a side of the supplying part 103 at the bottom of the inside of the toner tank 101. The toner-conveying member 105 may be formed in, for example, a coil spring shape. However, the present general inventive concept is not limited thereto. An end of the toner-conveying member 105 extends in an inside the supplying part 103 so that when the toner-conveying member 105 rotates, the toner in the toner tank 101 may be conveyed to the inside of the supplying part 103. The toner conveyed by the toner-conveying member 105 may be discharged to the outside through the toner outlet.

In exemplary embodiments, the toner-agitating member 110 may be rotatably disposed inside the toner tank 101 and may force the toner in the toner tank 101 to move in a radial direction. In an exemplary embodiment, when the toner-agitating member 110 rotates at central portion of the toner tank 101, the toner in the toner tank 101 is agitated to prevent the toner from solidifying. As a result, the toner moves down to the bottom of the toner tank 101 by a force, such as gravity. The toner-agitating member 110 includes a rotation shaft 112 and a toner agitating film 120. The rotation shaft 112 is rotatably disposed at the central portion of the toner tank 101 and has a driving gear (not illustrated) coaxially coupled with an end of the rotation shaft 112 projecting from a side of the toner tank 101. Therefore, a rotation of the driving gear causes the rotation shaft 112 to rotate. Also, the rotation shaft 112 may have a wing plate 114 to help fix the toner agitating film 120 to the rotation shaft 112. The wing plate 114 may be formed to be substantially symmetrical about the rotation shaft 112. In exemplary embodiments, the toner agitating film 120 has a width which corresponds to an inner length of the toner tank 101. Furthermore, the toner agitating film 120 may be elastically deformable. In an exemplary embodiment, the toner agitating film 120 may bend toward or away from a projection inside the toner tank 101, i.e., the supplying part 103.

Portions of the toner agitating film 120 may be cut off from the toner agitating film 120 toward the rotation shaft 112 to form a first agitating part 121 and a second agitating part 122.

An imaging apparatus according to an exemplary embodiment of the present general inventive concept includes an image carrier, an image forming unit to form an electrostatic latent image on a surface of the image carrier, a unit to receive a toner, a toner supplying unit to supply the toner onto the surface of the image carrier to develop the electrostatic latent image thereon, and a toner transferring unit to transfer the toner image to a transfer medium from the surface of the image carrier, wherein the toner includes a latex, a colorant, and a release agent, the toner having a complex viscosity ($\eta^*$) in a range of about $2.5\times10^2$ to about $1.0\times10^3$ Pa·s and a loss tangent (tan $\delta$) in a range of about 1.3 to about 2.3 at a temperature of about 160° C., wherein the $\eta^*$ is defined by a formula $\eta^*=(G'^2+G''^2)^{1/2}/w$, and the tan $\delta$ is defined by a formula $G''/G'$, where G' is a storage elastic modulus and G" is a loss elastic modulus as determined under the following conditions of an angular velocity being about 6.28 rad/s and at a temperature increasing at a rate of about 2.0° C./min.

Figure 2:
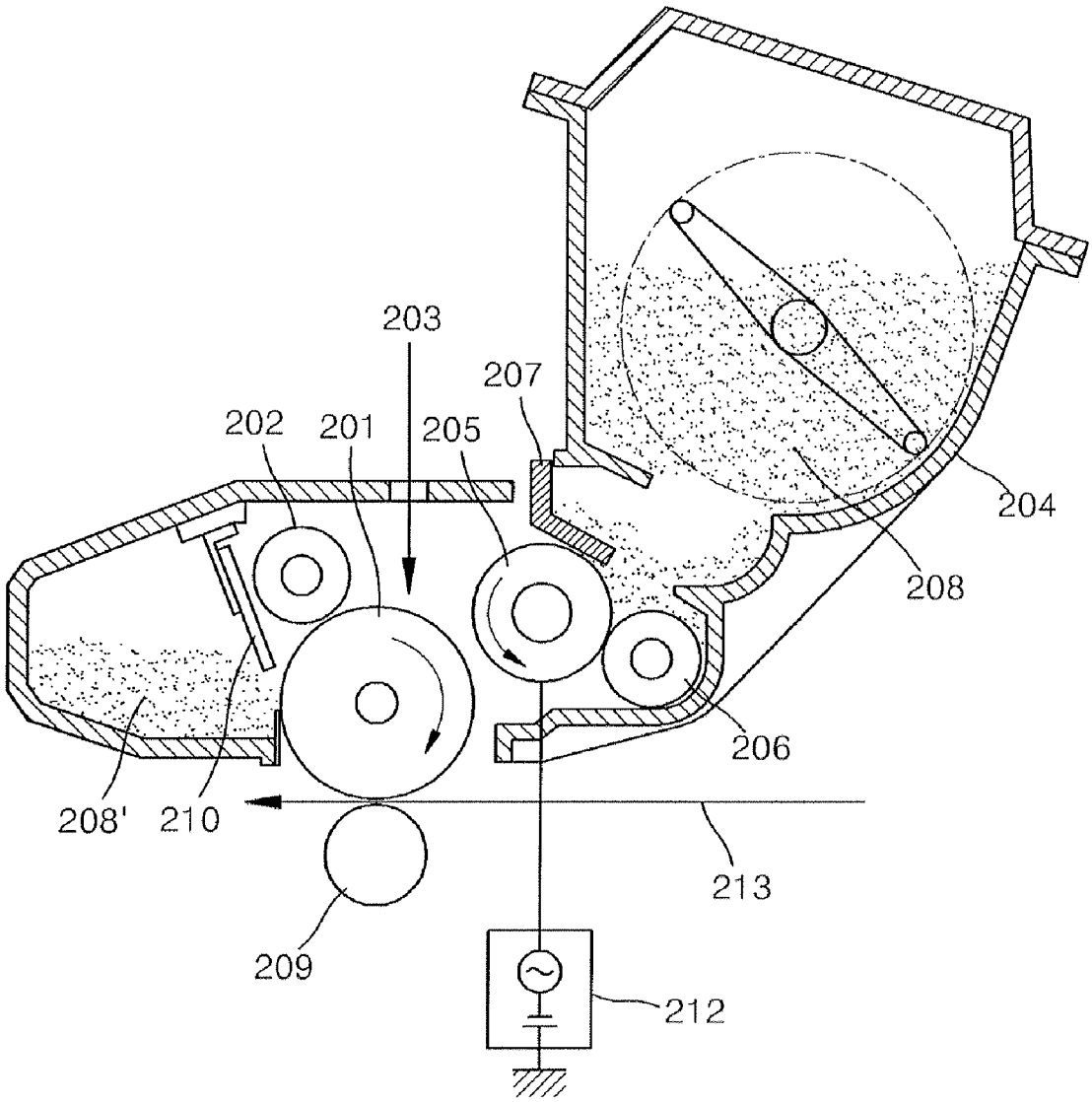
FIG. 2 is cross-sectional view of an image apparatus according to an exemplary embodiment of the present inventive concept.

FIG. 2 is a cross-sectional view of a non-contact development type imaging apparatus including toner prepared using a method according to an exemplary embodiment of the present general inventive concept.

A developer (such as a toner) 208 which includes a non-magnetic one-component of a developing device 204 is supplied to a developing roller 205 by a supply roller 206 formed of an elastic material, such as polyurethane foam or sponge. The developer 208 supplied to the developing roller 205 reaches a contact portion between a developer controlling blade 207 and the developing roller 205 due to a rotation of the developing roller 205. The developer controlling blade 207 may be formed of an elastic material, such as metal or rubber. When the developer 208 passes through the contact portion between the developer controlling blade 207 and the developing roller 205, the developer 208 may be controlled and formed into a thin layer which has a uniform thickness and may be sufficiently charged. The developer 208 which has been formed into a thin layer is transferred to a development region of a photoreceptor 201 which is an image carrier, in which a latent image is developed by the developing roller 205. At this time, the latent image is formed by scanning light 203 onto the photoreceptor 201.

The developing roller 205 is separated from the photoreceptor 201 by a predetermined distance and faces the photoreceptor 201. In an exemplary embodiment, referring to FIG. 2, the developing roller 205 rotates in a counter-clockwise direction and the photoreceptor 201 rotates in a clockwise direction.

The developer 208 which has been transferred to the development region of the photoreceptor 201 develops the latent image formed on the photoreceptor 201 by an electric force generated by a potential difference between a direct current (DC) biased alternating current (AC) voltage applied to the developing roller 205 and a latent potential of the photoreceptor 201 charged by a charging unit 202 so as to form a toner image. In exemplary embodiments, a voltage may be generated and/or controlled by a voltage controller 212.

The developer 208, which has been transferred to the photoreceptor 201, reaches a transfer unit 209 due to a rotation direction of the photoreceptor 201. In exemplary embodiments, the developer 208, which has been transferred to the photoreceptor 201, may be transferred to a print medium 213 to form an image by the transfer unit 209 having a roller shape and to which a high voltage having a polarity opposite to the developer 208 is applied, or by corona discharging when the print medium 213 passes between the photoreceptor 201 and the transfer unit 209. However, the present general inventive concept is not limited thereto.

The image transferred to the print medium 213 passes through a high temperature and high pressure fusing device (not illustrated) and thus the developer 208 is fused to the print medium 213 to form a fixed image. Meanwhile, a non-developed, residual developer 208' on the developing roller 205 may be collected by the supply roller 206 which contacts the developing roller 205, and the non-developed, residual developer 208' on the photoreceptor 201 is collected by a cleaning blade 210. The processes described above may be repeated as required.

The present general inventive concept will be described in further detail with reference to the following examples, which are for illustrative purposes only and are not intended to limit the scope of the present general inventive concept.

Shapes of toners prepared according to examples and comparative examples that follow were identified by scanning electron microscope (SEM) images. The degree of circularity of toner as defined by the following expression may be determined with a FPIA (FPIA-3000 Model, manufactured by Sysmex Corporation):

$$\text{Circularity}=2\times(\pi\times\text{area})0.5/\text{perimeter}$$

The circularity may be in a range of 0 to 1, with a value of 1 corresponding to a perfect circle.

Example 1

Synthesis of First Latex Particles

A monomer mixture of 234 g of styrene, 96 g of n-butyl acrylate, 14 g of methacrylic acid and 6.5 g of polyethylene glycol-ethyl ether methacrylate, and 5 g of dodecanthiol as a chain transfer agent were mixed. 500 g of 2% aqueous solution of SDS (Aldrich) was added to the monomer mixture to then be emulsified at a temperature from 60 to 80° C. using an ultrasonic homogenizer, to yield a polymerizable monomer emulsion. The prepared polymerizable monomer emulsion was added to a reactor that was heated to 80° C., 860 g of 3.2% potassium persulfate (KPS) aqueous solution as a polymerization initiator was added thereto, and then the resultant was reacted while nitrogen was purged into the reactor for 2 hours. When the reaction was terminated, a monomer mixture of 145 g of styrene, 66 g of n-butyl acrylate and 9 g of methacrylic acid, and 3.3 g of 1-dodecanethiol was added to the reactor using a starved-feeding method for 60 minutes and the mixture was further reacted for 6 hours. Then, the resultant was cooled naturally to obtain first latex particles. A particle size of the resultant toner latex was measured with a light scattering apparatus (Horiba 910) to be 140 nm.

Preparation of Colorant Dispersions 10 g of a mixture of an anionic reactive emulsifier (HS-10; Dai-ichi Kogyo) and a nonionic reactive emulsifier (RN-10; Dai-ichi Kogyo) in weight ratios illustrated in Table 2 below, 60 g of a colorant (black, cyan, magenta, yellow) and 400 g of glass beads each having a diameter of 0.8 to 1 mm were added to a milling bath, and the mixture was milled at room temperature to prepare a dispersion by using an ultrasonic homogenizer (VCX-750, by Sonics & Materials, Inc.).

TABLE 2

| Color | Type of pigment | HS-10:RN-10 (wt %) | Particle diameter (Size) |
|---|---|---|---|
| Black | Mogul-L | 100:0 | 130 nm |
| | | 80:20 | 120 nm |
| | | 0:100 | 100 nm |
| Yellow | PY-84 | 100:0 | 350 nm |
| | | 50:50 | 290 nm |
| | | 0:100 | 280 nm |
| Magenta | PR-122 | 100:0 | 320 nm |
| | | 50:50 | 300 nm |
| | | 0:100 | 290 nm |
| Cyan | PB 15:4 | 100:0 | 130 nm |
| | | 80:20 | 120 nm |
| | | 80:30 | 120 nm |

Preparation of Agglomerating Agents 47.3 g of 35.0% sulfuric acid and 80.5 g of distilled water were added in a 500 mL reaction vessel (e.g., a glass beaker) to prepare an aqueous sulfuric acid solution (A). 29.9% water glass from silicon dioxide ($SiO_2$), and 250 g of distilled water, were added in another 500 mL reaction vessel to prepare an aqueous solution of water glass (B).

While stirring 126 g of the prepared aqueous sulfuric acid solution (A) in a reaction vessel with a high-speed stirrer, 367.2 g of the prepared aqueous solution of water glass (B) was introduced into the reaction vessel containing the aqueous sulfuric acid solution (A) at a constant flow rate, i.e., one drop per second, to prepare an acidic silicic acid solution (C).

The reaction vessel containing the acidic silicic acid solution (C) was transferred to a water bath to perform polymerization according to variations of temperature and time, thereby preparing aqueous polymerizable silicate solutions having different molecular weights.

91.0 g of each of the prepared aqueous polymerizable silicate solutions was introduced into a 1-liter mass flask, 3.23 g of 37.5% ferric chloride was added until the 1-liter mass flask was completely filled, and the pH is adjusted to 1.5 with sulfuric acid (concentration: 35.0%) to thus prepare the agglomerating agent polysilica iron (PSI), containing 2 wt % of Fe, and Si and Fe in a molar ratio of 1:1. The prepared agglomerating agents PSI-A to PSI-E were evaluated by varying these parameters, and the results are illustrated in Table 3 below.

TABLE 3

| | PSI-A | PSI-B | PSI-C | PSI-D | PSI-E |
|---|---|---|---|---|---|
| Si/Fe molar ratio (Si/Fe) | | | 1 | | |
| Main Component Fe (wt %) | | | 2 | | |
| Concentration $SiO_2$ (wt %) | | | 2.2 | | |
| Specific Gravity (20° C.) | | | 1.08 | | |
| Reaction Temperature (° C.) | 53 | 55 | 57 | 59 | 61 |
| Reaction Time (min) | 60 | 90 | 120 | 150 | 180 |
| Average Molecular Weight (Dalton) | 92,000 | 220,000 | 500,000 | 741,000 | 980,000 |

Agglomeration and Preparation of Toners 500 g of deionized water, 150 g of the first latex particle for a core prepared according to the process described above, 35 g of a 19.5% cyan colorant dispersion (100% HS-10), and 27 g of 35% P-419 sold by Chukyo yushi Co., Ltd (a mixture of about 20 to 30% of a paraffin-based wax and about 10 to 20% of an ester-based wax; a melting point of about 88° C.) were added to a 1-L reactor. 15 g nitric acid (0.3 mol) and 15 g of 16% PSI-B as an agglomerating agent were added to the resultant mixture in the reactor and stirred at 11,000 rpm for 6 minutes using a homogenizer to obtain a first agglomerated toner having a volume average diameter of 1.5 to 2.5 μm. The resultant mixture was added to a 1-L double-jacketed reactor, and heated from room temperature to 50° C. (Tg of the latex-5° C. or larger) at a rate of 0.5° C. per minute. When a volume average particle diameter of the first agglomerated toner reached 5.8 μm, 50 g of a second latex prepared by polymerizing polystyrene-based polymerizable monomers was additionally added. When the volume average particle diameter reached 6.0 μm, NaOH (1 mol) was added thereto to adjust the pH to 7. When the volume average particle diameter was constantly maintained for 10 minutes, the temperature of the first agglomerated toner was increased to 96° C. at a rate of 0.5° C./min. When the temperature reached 96° C., nitric acid (0.3 mol) was added thereto to adjust the pH to 6.6. Then, the resultant was agglomerated for 3-5 hours to obtain a second agglomerated toner having a diameter of 5-6 μm in an elliptical shape. Then, a reactant of the second agglomerated toner was cooled to a temperature lower than Tg, filtered, and dried.

External additives were added to the toner by adding 0.5 parts by weight of NX-90 (Nippon Aerosil), 1.0 parts by weight of RX-200 (Nippon Aerosil), and 0.5 parts by weight of SW-100 (Titan Kogyo) to 100 parts by weight of the dried toner particles and then, the mixture was stirred using a mixer (KM-LS2K, Dae Wha Tech) at a rate of 8,000 rpm for 4 minutes. A toner having a volume average particle diameter of 5.9 μm was obtained.

GSDp and GSDv of the toner were respectively 1.297 and 1.211. An average circularity of the toner was 0.972.

Example 2

Toner was prepared in the same manner as in Example 1, except that instead of PSI-B, PSI-C was used as an agglomerating agent.

GSDp and GSDv of the toner were respectively 1.280 and 1.216. An average circularity of the toner was 0.972.

Example 3

Toner was prepared in the same manner as in Example 1, except that instead of PSI-B, PSI-D was used as an agglomerating agent.

GSDp and GSDv of the toner were respectively 1.271 and 1.210. An average circularity of the toner was 0.972.

Comparative Example 1

Toner was prepared in the same manner as in Example 1, except that instead of PSI-B, PSI-A was used as an agglomerating agent.

GSDp and GSDv of the toner were respectively 1.318 and 1.208. An average circularity of the toner was 0.972.

Comparative Example 2

Toner was prepared in the same manner as in Example 1, except that an amount of PSI-A used as an agglomerating agent, instead of PSI-B, was increased to 30 g.

GSDp and GSDv of the toner were respectively 1.323 and 1.210. An average circularity of the toner was 0.972.

Comparative Example 3

Toner was prepared in the same manner as in Example 1, except that instead of PSI-B, PSI-E was used as an agglomerating agent.

GSDp and GSDv of the toner were respectively 1.258 and 1.214. An average circularity of the toner was 0.972.

Comparative Example 4

Toner was prepared in the same manner as in Example 1, except that an amount of PSI-E used as an agglomerating agent, instead of PSI-B, was decreased to 7.5 g.

GSDp and GSDv of the toner were respectively 1.257 and 1.213. An average circularity of the toner was 0.972.

Evaluation of Toner Properties

Measurement of η* and tan δ

The η* and tan δ of toner were measured using an ARES apparatus produced by Rheometric Scientific Co. Samples were placed between two discs each having a diameter of 8 mm and the measurement was conducted in a linear region at a temperature in a range of about 40° C. to about 180° C. at a temperature rising rate of 2° C. per minute. Also, the measurement was conducted for 30 seconds and within an error range of 1° C. after initiating the measurement to ensure precision. The η* and tan δ of toner were calculated based on data values G' and G" of the obtained η* and tan δ.

Fluorescent X-Ray Analysis

Fluorescent X-ray analysis was performed using an energy dispersive X-Ray spectrometer (EDX-720) manufactured by Shimadzu Corporation under measuring conditions of a tube voltage being 40 KV, and the sample yield was in a range of about 3 g±0.01 g.

The sample ratios of [S]/[Fe] and [Si]/[Fe] were calculated using intensity values (unit: cps/μA) derived from quantitative data resulting from fluorescent X-ray analysis.

Evaluation of Fixing (Hot-Offset) Properties

Device: Belt-type fixing device, such as a Color Laser 660 model manufactured by Samsung Co., Ltd. Korea Unfixed image to be tested: 100% pattern Test temperature: 130 to 250° C. (5° C. intervals)

Fixing rate: 160 mm/sec

Fixing time: 0.08 to 0.16 sec

After performing experiments under the above-described conditions, the fixing properties of the fixed images were evaluated in the following manner.

After measuring the optical density (OD) of a fixed image, an image area is coated with an adhesive tape, e.g., 3M 810 tape, and is subjected to reciprocating motion 5 times by using a 500 g weight. Next, the tape is peeled off to measure the OD of the image.

Fixability (%)=(OD_After peeling/OD_Before peeling)×100

An area where the fixability is over 90% is considered as a fixing area of the toner.

Minimum Fusing Temperature (MFT) means a minimum temperature at which the fixability of the fixed image is over 90% without an occurrence of a cold-offset phenomenon. Hot-Offset Temperature (HOT) means a minimum temperature at which a hot-offset phenomenon occurs in the fixed image.

Evaluation of Gloss

The glossiness values were measured by using a glossmeter, such as micro-TRI-gloss manufactured by BYK Gardner, wherein the highest glossiness value was selected.

Measurement Angle: 60°

Measurement pattern: 100% pattern

Evaluation of High-Temperature Storage Stability 100 g of a toner was treated by using an external additive and then put into an oven with a constant temperature and humidity, as follows, in a packaged state:

23° C., 55% Relative Humidity (RH) 2 hour storage

=>40° C., 90% RH 48 hour storage

=>50° C., 80% RH 48 hour storage

=>40° C., 90% RH 48 hour storage

=>23° C., 55% RH 6 hour storage

After the toner was stored under the conditions described above, 100% of an image was printed out. Then, the image was visually observed to determine whether caking occurred or not and thus determine defective images.

Evaluation Criteria are defined as follows:

◎: Image quality was "excellent" and no caking occurred;

○: Image quality was "good" and no caking occurred;

Δ: Image quality was "poor" and no caking occurred; and

X: Image "defects" were observed and caking occurred.

Evaluation of Streaks

A 500-sheet durability test was performed under the 20 page per minute (PPM) and 0% operating condition using a color laser printer, such as a fixing device as Color Laser 660 Model sold by Samsung Co., Ltd., Korea. To determine an occurrence or nonoccurrence of streaks, the image was evaluated based on whether transfer medium (ex. printing paper) was contaminated or not. The state of contamination and any influence on the image due to the contamination were visually observed and evaluated according to the following criteria:

◎: Little Contamination is observed, and no image defects occur at all;

○: Some Contamination is observed, but do not affect images;

Δ: Contamination is observed, but do not affect images; and

X: Severe contamination is observed, and adversely affects images.

The results of the evaluation on the toners according to Examples 1 through 3 and Comparative Examples 1 through 4 are illustrated in Table 4 below.

TABLE 4

| | Rheological properties (at 160° C.) | | Fixing properties | | | Durability | | | |
|---|---|---|---|---|---|---|---|---|---|
| | η* (Pa · s) | Tan δ (G"/G') | MFT (° C.) | HOT (° C.) | Gloss | Storage Stability | Streaks | [Si]/[Fe] | [S]/[Fe] |
| Example 1 | $7.0 \times 10^2$ | 1.33 | 160 | 220 | 5.7 | ◎ | ◎ | $4.7 \times 10^{-3}$ | $6.8 \times 10^{-3}$ |
| Example 2 | $4.3 \times 10^2$ | 1.77 | 150 | 220 | 7.1 | ◎ | ◎ | $3.9 \times 10^{-3}$ | $6.1 \times 10^{-3}$ |
| Example 3 | $4.2 \times 10^2$ | 2.21 | 140 | 215 | 8.2 | ○ | ○ | $5.1 \times 10^{-3}$ | $7.3 \times 10^{-3}$ |
| Comp. Example 1 | $8.2 \times 10^2$ | 0.72 | 165 | 220 | 3.1 | ◎ | ◎ | $4.1 \times 10^{-3}$ | $5.5 \times 10^{-3}$ |
| Comp. Example 2 | $10.3 \times 10^2$ | 0.58 | 175 | 230 | 2.5 | ◎ | ◎ | $1.2 \times 10^{-3}$ | $2.6 \times 10^{-3}$ |
| Comp. Example 3 | $3.6 \times 10^2$ | 2.51 | 135 | 215 | 10.1 | Δ | Δ | $4.4 \times 10^{-3}$ | $6.5 \times 10^{-3}$ |
| Comp. Example 4 | $2.2 \times 10^2$ | 2.66 | 130 | 205 | 9.9 | X | X | $7.8 \times 10^{-3}$ | $1.01 \times 10^{-2}$ |

Referring to Table 4, the toners according to Examples 1 through 3 having a η* in a range of about $2.5\times10^2$ to about $1.0\times10^3$ Pa·s and a tan δ in a range of about 1.3 to about 2.3 at 160° C. exhibited excellent fixability and high-temperature storage stability.

However, the toners according to Comparative Examples 1 and 2 using a PSI-A agglomerating agent having a small molecular weight exhibited rheological properties outside of the tan δ ranges to have a high MFT, resulting in a reduction in the fixing area and degradation in gloss. The toners according to Comparative Examples 3 and 4 using a PSI-E agglomerating agent having too high of a molecular weight exhibited rheological properties outside of the tan δ ranges to have an unsuitable viscoelasticity, thereby resulting in undesirable high-temperature toner storage stability and streaks in the fixed image.

Although various example embodiments of the present general inventive concept have been illustrated and described, it will be appreciated by those skilled in the art that changes may be made in these embodiments without departing from the principles and spirit of the present general inventive concept, the scope of which is defined in the appended claims and their equivalents.

What is claimed is:

1. A toner to develop an electrostatic latent image, the toner comprising:

a latex;

a colorant; and a release agent, wherein the toner has a complex viscosity (η*) in a range of about $2.5\times10^2$ to about $1.0\times10^3$ Pa·s and a loss tangent (tan δ) in a range of about 1.3 to about 2.3 at a temperature of about 160° C., the η* is defined by a formula η*=(G'2+G"2)½/w, and the tan δ is defined by a formula G"/G', where G' is a storage elastic modulus and G" is a loss elastic modulus as determined under the following conditions of an angular velocity being about 6.28 rad/s and at a temperature increasing at a rate of about 2.0° C./min, and the toner has a Si/Fe ratio in a range of about $5.0\times10^{-4}$ to about $5.0\times10^{-2}$.

2. The toner of claim 1, wherein the toner further comprises silicon (Si),wherein the toner has a S/Fe ratio in a range of about $5.0\times10^{-4}$ to about $5.0\times10^{-2}$.

3. The toner of claim 1, wherein the toner comprises each of the Si and Fe in a range of about 3 ppm to about 30,000 ppm.

4. The toner of claim 1, wherein the release agent comprises a mixture comprising a paraffin-based wax and an ester-based wax or an ester group-containing paraffin-based wax.

5. The toner of claim 4, wherein if the releasing agent comprises a mixture comprising:

the paraffin-based wax and the ester-based wax, an amount of the ester-based wax is in a range of about 5 to about 39 parts by weight % based on a total weight of the releasing agent.

6. The toner of claim 1, wherein a volume average particle diameter is in a range of about 3 μm to about 8 μm.

7. The toner of claim 1, wherein an average circularity of the toner is in a range of about 0.940 to about 0.990.

8. The toner of claim 1, wherein a volume average particle diameter distribution coefficient (GSDv) of the toner is about 1.30 or less, and a number average particle diameter distribution coefficient (GSDp) of the toner is about 1.30 or less.

* * * * *